US005556038A

United States Patent [19]

Nakamura et al.

[11] Patent Number: 5,556,038

[45] Date of Patent: Sep. 17, 1996

[54] METHOD FOR PRODUCING ULTRA FINE PARTICLES

[75] Inventors: Masayoshi Nakamura; Teruaki Ohki; Shougo Kodama, all of Tokyo, Japan

[73] Assignee: Showa Shell Sekiyu K.K., Tokyo, Japan

[21] Appl. No.: 305,965

[22] Filed: Sep. 16, 1994

[30] Foreign Application Priority Data

Sep. 20, 1993 [JP] Japan ..... 5-256444

[51] Int. Cl.[6] ..... B02C 23/36

[52] U.S. Cl. ..... 241/17; 241/21

[58] Field of Search ..... 241/17, 21, 27, 241/30, 172, 184

[56] References Cited

U.S. PATENT DOCUMENTS

| | | | |
|---|---|---|---|
| 3,311,310 | 3/1967 | Engels et al. | 241/172 X |
| 3,337,140 | 8/1967 | Wahl | 241/172 X |
| 3,640,476 | 2/1972 | Engels | 241/172 X |
| 3,682,399 | 8/1972 | Kaspar et al. | 241/172 X |
| 4,332,354 | 6/1982 | Monterey et al. | 241/172 X |
| 4,430,279 | 2/1984 | Hagio et al. | 241/184 X |
| 5,065,946 | 11/1991 | Nishida et al. . | |

FOREIGN PATENT DOCUMENTS

| | | |
|---|---|---|
| 483808 | 5/1992 | European Pat. Off. . |
| 4234759 | 4/1994 | Germany . |
| 2132162 | 5/1990 | Japan . |
| 679552 | 9/1952 | United Kingdom . |
| 980923 | 1/1965 | United Kingdom . |

OTHER PUBLICATIONS

Patent Abstracts of Japan, vol. 16, No. 320 (C–0962), 14 Jul. 1992 for JP–A–4–92818.

Patent Abstracts of Japan, vol. 17, No. 591 (C–1125), 28 Oct. 1993 for JP–A–5–178620.

*Primary Examiner*—Timothy V. Eley

*Attorney, Agent, or Firm*—Sughrue, Mion, Zinn, Macpeak & Seas

[57] ABSTRACT

A method for producing ultra fine particles is disclosed, wherein the method includes wet grinding particles with a media agitation mill, wherein ceramic particles having an average diameter of about 300 μm or smaller are used as grinding media in the media agitation mill. Desirably, the media has an average particle diameter standard deviation of 15 or smaller, a sphericity of 1.07 or smaller, and a density of 6.0 g/cm$^3$ or more.

9 Claims, No Drawings

METHOD FOR PRODUCING ULTRA FINE PARTICLES

FIELD OF THE INVENTION

This invention relates to a method for producing ultra fine particles for use in raw particles for pigments, electron parts, medical products, agricultural products, food and the like chemical products.

BACKGROUND OF THE INVENTION

Recently, a demand for ultra fine particles having a particle diameter of submicrons is increasing in many industrial fields (for instance, high technology fields as well as fine ceramics fields). As one means for meeting this demand, the use of a media agitation mill has come to attention in view of its advantage of cost savings. The media agitation mill uses beads (sometimes called balls, media or ball pebbles) as grinding media. As a material thereof, a metal, glass or ceramic has been mainly used. However, beads made of a metal or glass formed during the grinding step or abrasive particles or impaired peeled pieces thereof generated by abrasion or cracking contaminate a final product to cause pollution, resulting in deterioration of quality and irregular quality. Thus, since they directly and adversely affect the final product, it has come to attention to use ceramic beads, especially zirconia beads in which an yttria stabilizer is contained, which is less influenced by the above factors, and the use thereof is increasing.

Conventionally, in cases where beads are used as a media for grinding particles, it is said that it is better to use beads having a high density, a small average particle diameter, a narrow distribution breadth and a nearly spherical shape. Accordingly, a demand on the market is increasing for beads made of, e.g., zirconia or other ceramic materials, having a high density (when it is the same ceramics, the nearer the theoretical density is better), a small average particle diameter, a narrow distribution breadth and a nearly spherical shape. In particular, since zirconia beads have higher density than those of other ceramic materials and are abundant in abrasion resistance, it is said that a demand for beads made of zirconia having a smaller shape, narrower particle diameter distribution breadth and more nearly spherical shape will become stronger from now on.

Beads having a small particle diameter (e.g., 200 μm or 300 μm) made of a metal or glass as a material have been already on the market, and they have a relatively high sphericity. Zirconia beads having an average particle diameter of 400 μm are obtainable on the market and put in practical use as grinding media. Also, it is possible to obtain zirconia beads having an average particle diameter of 300 μm, however, in cases of those having an average particle diameter of 300 μm, the density thereof is 6.0 g/cm$^3$ or smaller, the particle diameter distribution thereof is broad (25 to 30 μm in the standard deviation), and the sphericity thereof is 1.1 or higher, which are not sufficient levels. It is considered that these disadvantages are attributed to conventional granulating methods such as a rolling method, a fluidized bed method, or an agitation method. Accordingly, the present inventors have found that 1) there is a technical possibility to produce zirconia beads having an average particle diameter of 400 μm or smaller, high density, narrow particle distribution and good sphericity and 2) it is preferred to use the beads as grinding media in agitation mills.

SUMMARY OF THE INVENTION

An object of the present invention is to provide a method for producing ultra fine particles which is consistently high in quality.

The present invention achieves this and other objects by providing a method in which ultra fine particles are produced by wet grinding (inclusive of mixture and dispersion) particles with a media agitation mill using, as grinding media, ceramic particles having an average particle diameter of about 300 μm or smaller, such as zirconia particles.

With respect to the media, the standard deviation for the average particle diameter desirably is 15 or smaller, preferably 10 or smaller, the sphericity desirably is 1.07 or smaller, preferably 1.05 or smaller, and the density desirably is 6.0 g/cm$^3$ or more, preferably 6.0 to 6.09 g/cm$^3$. An average particle diameter of 40 to 300 μm is particularly preferred. Furthermore, it is preferred that the relationship of Y (the standard deviation for the average particle diameter) with X (the average particle diameter, μm) satisfies the following equation: $Y= -17.84+ 5.8031nX$, the sphericity is 1.07 or smaller, preferably 1.05 or smaller, and the density is 6.0 g/cm$^3$.

The present invention also provides a method for producing ultra fine particles in which primary particles are obtained by a method described above, the primary particles are calcined to form calcined particles, the calcined particles are subjected to grinding to form ground particles, and the ground particles are subjected to a method described above.

DETAILED DESCRIPTION OF THE PREFERRED EMBODIMENT

The media used in the present invention is prepared by the method of agglomeration in liquid as disclosed, for example, in JP-A-4-92818, JP-A-6-182177, JP-A-5-178618, JP-A-5-178620, JP-A-5-285362, JP-A-5-293356, JP-A-5-309556, JP-A- 6-126147, Japanese Patent No. 1,802,204, JP-B-5-8127, JP-A- 64-45711, JP-A-3-72938, etc. (The term "JP-A" as used herein means an "unexamined published Japanese patent application" and the term "JP-B" as used herein means an "examined Japanese patent publication".) As an example for the media, it includes yttria stabilized zirconia beads, silica and alumina green pellets which are granulated by this method.

An appropriate condition for the media used in the present invention is determined as follows: By using zirconia (called PSZ) beads using yttria as a stabilizer, some beads each having a different density, average particle diameter, particle diameter distribution breadth and sphericity are prepared, and commercially available particles made of metal oxides are ground by a variety of zirconia materials containing an yttria stabilizer each having the same average particle diameter but having a different standard deviation, density and sphericity with a commercially available media agitation mill to determine an appropriate condition as the media.

As raw particles for grinding, mixed particles comprising the same amount of titanium oxide ($TiO_2$) and lead oxide ($Pb_3O_4$) each on the market can be used, in which the average particle diameter is 2.39 μm (determined by the sedimentation method using SEDIGRAPH 5000D of MICROMERTICS CO. ).

As a media agitation mill, a horizontal media agitation mill (Dyno mill of SHINMARU ENTERPRISES CORP., TYPE KDL WILLY A BACHOFEN AG MASCHINENFABRIK BASEL SCHWEIZ 0.6L (77×150 mm), DISC 64 mmϕ) can be used.

A grinding condition is as follows: The raw particle mixture is added to pure water having 1.5 times the volume of the raw particles mixture to make a slurry. 0.4wt % (based on the raw particles mixture) of a commercially available polycarboxylic acid type dispersion is added to the slurry to improve the dispersibility of the particles and the flowability of the slurry. After preliminary mixing with a mixer, the resulting suspension is filled in a grinding machine with a roller pump, and then ground. The circumferential speed of the disc is set to 14 m/sec.

As grinding media for testing, zirconia beads are prepared as follows: To a cylindrical agglomeration machine (inner volume: 3,000 ml) are charged 80 g of zirconia particles (average particle diameter: 0.49 μm, specific surface area: 7.5 $m^2/g$) containing a small amount of commercially available yttria as a partial stabilizer, 2,800 ml of a paraffinic solvent, and a predetermined amount of water as a bridging liquid, then agglomeration in liquid is conducted with a mixing blade rotational speed of 1,800 r.p.m. at an internal agglomeration machine temperature of 40° C. to 45° C. for a predetermined period of time.

The amount of a bridging liquid is small if the size of beads to be prepared is small. For instance, when the average particle diameter thereof is 100 μm, the bridging liquid is used in an amount of 7.0 ml, and when the average particle diameter thereof is 300 μm, it is 8.2 ml. The agglomeration time is 90 minutes when the average particle diameter is 100 μm, and it is 60 minutes when the average particle diameter is 300 μm. Thus, these conditions are different depending on the desired products. Furthermore, by varying the agglomeration conditions, beads each having nearly the same average particle diameter but having a different density, sphericity and particle diameter distribution can be prepared by using the same raw particles. The resulting product is sintered at 1480° C. for 2 hours to provide a sintered product. The surface of sintered product is polished to provide beads as a final product. With respect to the final beads, the density is determined by the Archimedes method, the average particle diameter is determined by an image analyzer (e.g., one made by NIRECO Corp.), the standard deviation is determined by the measured values of more than 100 test samples. The sphericity is determined by the maximum particle length (ML) of each bead obtained from an image of the image analyzer and the largest breadth diameter of crossing the right angle thereto (BD), and is represented as ML/BD (in case of a real sphere: ML/BD= 1).

Zirconia beads and the measured values thereof obtained by these agglomeration conditions are set forth in Table 1.

TABLE 1

| Kinds of Beads by Nominal Diameter | Average Particle Diameter of Beads (μm) | Standard Deviation of Average Particle Diameter | Density ($g/cm^3$) | Sphericity | Remarks |
|---|---|---|---|---|---|
| 300 μm | | | | | |
| A: | 302 | 10 | 6.07 | 1.05 | O |
| B: | 304 | 21 | 6.00 | 1.14 | X |
| 250 μm | | | | | |
| A: | 255 | 10 | 6.04 | 1.04 | O |
| B: | 251 | 20 | 5.95 | 1.11 | X |
| 200 μm | | | | | |
| A: | 197 | 8 | 6.05 | 1.04 | O |
| B: | 195 | 14 | 5.97 | 1.14 | X |

TABLE 1-continued

| Kinds of Beads by Nominal Diameter | Average Particle Diameter of Beads (μm) | Standard Deviation of Average Particle Diameter | Density ($g/cm^3$) | Sphericity | Remarks |
|---|---|---|---|---|---|
| 150 μm | | | | | |
| A: | 152 | 8 | 6.06 | 1.05 | O |
| B: | 150 | 16 | 5.93 | 1.10 | X |
| 100 μm | | | | | |
| A: | 98 | 6 | 6.08 | 1.05 | O |
| B: | 101 | 12 | 5.90 | 1.11 | X |
| 50 μm | | | | | |
| A: | 55 | 4 | 6.08 | 1.05 | O |
| B: | 57 | 7 | 5.94 | 1.10 | X |

Note:
O = Good, X = Acceptable

When grinding is conducted with the above-mentioned media agitation mill using six kinds of the beads of 300 μm or smaller having nearly the same average particle diameter but having a different particle diameter distribution breadth (represented by the standard deviation of the average particle diameter), sphericity and density as grinding media, it is confirmed that even though beads having a nearly the same particle diameter are used, if the beads are different in the particle diameter distribution breadth, density and sphericity, a significant difference in the grinding properties is observed in respect of a grinding time to make same size fine particles and the amount of bead wear during grinding, so the beads having a narrower particle diameter distribution breadth, higher density and higher sphericity as in a preferred embodiment of the present invention are advantageous in the production of ultra fine particles.

In a preferred embodiment, the wet grinding is conducted twice. In this embodiment, the (primary) particles obtained in a method described above (the first grinding) are calcined at about 750° to 850° C., preferably about 790° to 810° C. for about 1.5 to 4.0 hours, preferably about 2.5 to 3.5 hours for changing the physical mixture state of the particles to a single phase. Since the calcined particles are a solid agglomerate, after preliminary grinding the calcined particles, the ground particles are subjected to a method described above (the second wet grinding is conducted). The particles thus obtained are preferred to use a raw material for electron arts.

The present invention will be further described in the following non-limiting examples. Unless otherwise indicated, all parts, percents, ratios, and the like are by weight.

EXAMPLE

In this example, particles for grinding, a grinding machine, and the grinding conditions were the same as those described above. Grinding was conducted using the 12 kinds of-beads as set forth in Table 1 above. Properties thereof were evaluated by considering the time required for grinding particles having an average particle diameter of 2.39 μm to that having an average particle diameter of 0.2 μm and by considering the polluted amount caused by bead wear (represented by percent by weight for the amount of the ground particles).

The results are set forth in Table 2 below.

TABLE 2

| Kinds of Beads by Nominal Diameter | Average Particle Diameter of Beads (μm) | Standard Deviation of Average Particle Diameter | Density (g/cm$^3$) | Sphericity | Time Required to Make 0.2 μm (sec) | % Amount of Beads Wear (per raw material) |
|---|---|---|---|---|---|---|
| 300 μm | | | | | | |
| A: | 302 | 10 | 6.07 | 1.05 | 350 | 0.012 |
| B: | 304 | 21 | 6.00 | 1.14 | 415 | 0.022 |
| 250 μm | | | | | | |
| A: | 255 | 10 | 6.04 | 1.04 | 290 | 0.002 |
| B: | 251 | 20 | 5.95 | 1.11 | 315 | 0.008 |
| 200 μm | | | | | | |
| A: | 197 | 8 | 6.05 | 1.04 | 265 | — |
| B: | 195 | 14 | 5.97 | 1.14 | 280 | — |
| 150 μm | | | | | | |
| A: | 152 | 8 | 6.06 | 1.05 | 240 | — |
| B: | 150 | 16 | 5.93 | 1.10 | 255 | — |
| 100 μm | | | | | | |
| A: | 98 | 6 | 6.08 | 1.05 | 200 | — |
| B: | 101 | 12 | 5.90 | 1.11 | 215 | — |
| 50 μm | | | | | | |
| A: | 55 | 4 | 6.08 | 1.05 | 170 | — |
| B: | 57 | 7 | 5.94 | 1.10 | 180 | — |

As shown in Table 2 above, it was confirmed that as the average particle diameter of the beads became smaller, the time for grinding to reach the average particle diameter of 0.2 μm became shorter. It was further confirmed that as the particle diameter of the beads became smaller, the pollution caused by bead wear became less. Moreover, even if the average particle diameter was about the same, the beads having a narrower particle diameter distribution, higher density and higher sphericity provided superior results without exception, which enabled the particles to be ground to a desired particle-diameter in a shorter period of time. With respect to the pollution caused by bead wear of the 300 μm or 250 μm beads, it was revealed that the use of those having a narrower particle diameter distribution breadth, higher density and higher sphericity favorably provided smaller values.

From the above results, it is understood that even if the particle diameter of beads is identical, those having a narrower particle diameter distribution breadth, higher density and higher sphericity are more effective with respect to grinding time, and are superior in avoiding pollution.

As a result of the development of the wet grinding method, fine particles of submicron size which has not been obtained so far can be obtained in a short period of time by using, as grinding media, ceramic particles (such as zirconia beads) having an average particle diameter of 300 μm or smaller, a narrow particle diameter distribution, a high density and a high sphericity. Furthermore, a reduction in pollution due to bead wear can be accomplished.

While the invention has been described in detail and with reference to specific embodiments thereof, it will be apparent to one of ordinary skill in the art that various changes and modifications can be made therein without departing from the spirit and scope thereof.

What is claimed is:

1. A method for producing ultra fine particles, said method comprising wet grinding particles with a media agitation mill, wherein ceramic particles having an average particle diameter of about 300 μm or smaller are used as grinding media in the media agitation mill, wherein said method comprises wet grinding particles with a media agitation mill for 415 seconds or less.

2. A method for producing ultra fine particles as claimed in claim 1, wherein said method comprises wet grinding particles with a media agitation mill to produce ultra fine particles having an average particle size of 0.2 μm.

3. A method for producing ultra fine particles as claimed in claim 1, wherein the ceramic particles are zirconia particles stabilized by yttria.

4. A method for producing ultra fine particles, said method comprising wet grinding particles with a media agitation mill, wherein ceramic particles having an average particle diameter of about 300 μm or smaller are used as grinding media in the media agitation mill, wherein the media has an average particle diameter standard deviation of 15 or smaller, a sphericity of 1.07 or smaller, and a density of 6.0 g/cm$^3$ or more.

5. A method for producing ultra fine particles, said method comprising wet grinding particles with a media agitation mill, wherein ceramic particles having an average particle diameter of about 300 μm or smaller are used as grinding media in the media agitation mill, wherein the media has an average particle diameter of 40 to 300 μm, an average particle diameter standard deviation which satisfies the following equation:

$$Y=-17.84+5.8031nX$$

wherein Y represents the average particle diameter standard deviation and X represents the average particle diameter in μm, a sphericity of 1.07 or smaller, and a density of 6.0 g/cm$^3$ or more.

6. A method for producing ultra fine particles, said method comprising:

obtaining primary particles by wet grinding raw material particles with a media agitation mill, wherein ceramic particles having an average particle diameter of about 300 μm or smaller are used as grinding media in the media agitation mill;

calcining the primary particles to form calcined particles;

grinding the calcined particles to form ground particles; and obtaining ultra fine particles by wet grinding the ground particles with a media agitation mill, wherein ceramic particles having an average particle diameter of about 300 μm or smaller are used as grinding media in the media agitation mill.

7. A method for producing ultra fine particles as claimed in claim 6, wherein the media used in wet grinding said raw material particles has an average particle diameter standard deviation of 15 or smaller, a sphericity of 1.07 or smaller, and a density of 6.0 g/cm$^3$ or more.

8. A method for producing ultra fine particles as claimed in claim 7, wherein the media used in wet grinding said ground particles has an average particle diameter standard deviation of 15 or smaller, a sphericity of 1.07 or smaller, and a density of 6.0 g/cm$^3$ or more.

9. A method for producing ultra fine particles as claimed in claim 6, wherein the media used in wet grinding said ground particles has an average particle diameter standard deviation of 15 or smaller, a sphericity of 1.07 or smaller, and a density of 6.0 g/cm$^3$ or more.

* * * * *